US006561881B2

(12) United States Patent
Jeong

(10) Patent No.: US 6,561,881 B2
(45) Date of Patent: May 13, 2003

(54) SYSTEM AND METHOD FOR CHEMICAL MECHANICAL POLISHING USING MULTIPLE SMALL POLISHING PADS

(75) Inventor: In Kwon Jeong, Sunnyvale, CA (US)

(73) Assignee: Oriol Inc., Santa Clara, CA (US)

( * ) Notice: Subject to any disclaimer, the term of this patent is extended or adjusted under 35 U.S.C. 154(b) by 0 days.

(21) Appl. No.: 09/810,909

(22) Filed: Mar. 15, 2001

(65) Prior Publication Data

US 2002/0132566 A1 Sep. 19, 2002

(51) Int. Cl.[7] ..... B29B 1/00
(52) U.S. Cl. ..... 451/57; 451/285; 451/398
(58) Field of Search ..... 451/57, 285, 286, 451/287, 288, 289, 413, 398, 41, 63, 65

(56) References Cited

U.S. PATENT DOCUMENTS 3,665,648 A * 5/1972 Yamanaka ..... 451/12
3,874,123 A * 4/1975 Hopkins et al. ..... 451/271
4,128,968 A * 12/1978 Jones ..... 451/158
4,693,036 A * 9/1987 Mori ..... 451/287
5,674,115 A * 10/1997 Yamashita et al. ..... 451/285
6,004,187 A * 12/1999 Nyui et al. ..... 451/285
6,022,807 A * 2/2000 Lindsey et al. ..... 216/38
6,227,950 B1 * 5/2001 Hempel et al. ..... 451/288
6,251,785 B1 * 6/2001 Wright ..... 156/345
6,296,550 B1 * 10/2001 Liu et al. ..... 451/287
6,340,326 B1 * 1/2002 Kistler et al. ..... 451/286
6,343,980 B1 * 2/2002 Abe et al. ..... 451/292
6,379,230 B1 * 4/2002 Hayashi et al. ..... 451/287

* cited by examiner

*Primary Examiner*—Eileen P. Morgan
*Assistant Examiner*—Hadi Shakeri
(74) *Attorney, Agent, or Firm*—Wilson & Ham; Thomas H. Ham

(57) ABSTRACT

A system and method for chemically and mechanically polishing surfaces of semiconductor wafers utilizes multiple polishing pads having diameters that are smaller than the diameter of the wafers to simultaneously polish a given semiconductor wafer. The use of these smaller-sized polishing pads can significantly reduce the footprint of the system. Furthermore, the simultaneous polishing of the wafers by the multiple smaller-sized polishing pads can significantly increase the throughput for short period planarization. In addition, by independently controlling the lateral movement, the vertical movement and the rotational speed of each of the polishing pads during polishing, the system and method can more precisely control the amount of polishing at different regions of a wafer surface.

6 Claims, 9 Drawing Sheets

SYSTEM AND METHOD FOR CHEMICAL MECHANICAL POLISHING USING MULTIPLE SMALL POLISHING PADS

FIELD OF THE INVENTION

The invention relates generally to chemical mechanical polishing (CMP) systems, and more particularly to a system and method for polishing semiconductor wafers using polishing pads having diameters that are smaller than the diameter of the wafers being polished.

BACKGROUND OF THE INVENTION

During a fabrication process of a high density multilayered semiconductor device, one of the most important processing steps is planarizing a layer of a semiconductor wafer by removing uneven topographic features of the wafer. The layer planarization allows patterns that are subsequently formed above that layer to be more uniform. In the case of conductive patterns, the planarization of the underlying layer reduces the probability of electrical shorts between the conductive patterns, which is a growing concern as the density of microelectronic circuitry included in a semiconductor device is progressively increased.

Chemical mechanical polishing (CMP) is a well-accepted technique to planarize a layer of a semiconductor wafer during the fabrication process by chemically and mechanically removing uneven topographic features of the wafer. A conventional CMP technique involves polishing the surface of a wafer with a rotating polishing pad using a slurry of colloidal particles in an aqueous solution. The slurry promotes planarization of the wafer surface by producing a chemical reaction with the wafer surface and by providing abrasives to "grind" the wafer surface with the polishing pad. Typically, the polishing pad used for CMP is larger than the wafer being polished. That is, the diameter of the polishing pad is greater than the diameter of the wafer. Thus, the entire surface of a wafer is usually polished by a single polishing pad. For many CMP techniques, the polishing of the wafer surface is followed by a buffing step, during which the wafer surface may be further polished using a slurry containing finer abrasive particles. After the buffing step, the wafer is then cleaned and dried, which completes the CMP process. Thus, a typical CMP system includes a polishing unit, a buffing unit, and a cleaning unit.

In order to increase the throughput of planarized wafers, CMP systems have been developed that can simultaneously polish and/or buff multiple semiconductor wafers. The polishing of multiple wafers is accomplished by using a single large polishing pad to collectively polish the multiple wafers, or a number of different polishing pads to individually polish the wafers. Similarly, the buffing of multiple wafers is accomplished by using a single large buffing pad, or a number of different buffing pads.

A concern with these conventional CMP systems is that the amount of polishing at different regions of a wafer surface by a large polishing pad cannot be controlled with any significant degree of precision, which may result in a non-uniform wafer surface.

Another concern with the conventional CMP systems is that the footprint of the systems tends to be large, partly due to the large polishing pads. In addition, the increase in throughput is not as significant for planarization of semiconductor wafers that require short polishing periods.

In view of the above concerns, there is a need for a system and method for chemically and mechanically polishing semiconductor wafers that provides more precise control of the amount of polishing at different regions of a wafer surface, increased throughput for short period planarization, and reduced footprint for the system.

SUMMARY OF THE INVENTION

A system and method for chemically and mechanically polishing surfaces of semiconductor wafers utilizes multiple polishing pads having diameters that are smaller than the diameter of the wafers to simultaneously polish a given semiconductor wafer. The use of these smaller-sized polishing pads can significantly reduce the footprint of the system. Furthermore, the simultaneous polishing of the wafers by the multiple smaller-sized polishing pads can significantly increase the throughput for short period planarization. In addition, by independently controlling the lateral movement, the vertical movement and the rotational speed of each of the polishing pads during polishing, the system and method can more precisely control the amount of polishing at different regions of a wafer surface.

In one embodiment, a system in accordance with the present invention includes a rotatable platform that provides support for an object to be polished, a number of rotatable polishing pads, and a movement mechanism for independently moving each of the rotatable polishing pads laterally across a surface of the object. The rotatable polishing pads includes at least one pad having a surface area smaller than the surface area of the object to be polished. The movement mechanism is configured such that at least two rotatable polishing pads can be positioned over the surface of the object to simultaneously polish the object.

In another embodiment, the system includes a scanning mechanism for scanning each of the rotatable polishing pads laterally across the surface of the object about a fixed axis, instead of the movement mechanism. The scanning mechanism is also configured such that at least two rotatable polishing pads can be positioned over the surface of the object to simultaneously polish the object. In this embodiment, the scanning mechanism may include a mechanical arm having the rotatable polishing pads. The mechanical arm is configured to pivot about the fixed axis such that the rotatable polishing pads can be positioned over the surface of the object to simultaneously polish the object. The mechanical arm may include a first section and a second section. Each of the mechanical arm sections has one of the rotatable polishing pads. The second section of the mechanical arm is configured to pivot about the end of the first second of the mechanical arm.

In either embodiment, the movement mechanism or the scanning mechanism may include a first mechanical arm having a first rotatable polishing pad and a second mechanical arm having a second rotatable polishing pad. Each of the mechanical arms is configured to pivot about an arm axis such that the object is scanned by the first and second rotatable polishing pads when the first and second mechanical arms are pivoted. In addition, the movement or scanning mechanism may further include a controller that controls pivoting movements of the first and second mechanical arms. The controller is configured to control the first and second mechanical arms to position both the first and second rotatable polishing pads over the surface of the object so that the first and second rotatable polishing pads can simultaneously polish the object.

In either embodiment, the system may also include a secondary rotatable platform that provides support for a second object to be polished. In addition, the movement or scanning mechanism may include a multi-object mechanical arm having a multi-object rotatable polishing pad, which has a surface area smaller than the surface areas of the object and the second object. The multi-object mechanical arm is configured to pivot about an arm axis such that the multi-object rotatable polishing pad can scan the object and the second object to polish both the object and the second object when the multi-object mechanical arm is pivoted. Furthermore, the movement or scanning mechanism may also include a first primary mechanical arm having a first rotatable polishing pad and a second primary mechanical arm having a second rotatable polishing pad. The first primary mechanical arm is configured to pivot such that the object is scanned by the first rotatable polishing pad when the first primary mechanical arm is pivoted. The second primary mechanical arm is configured to pivot such that the object is scanned by the second rotatable polishing pad when the second primary mechanical arm is pivoted.

In either embodiment, the system may also include a rotational drive mechanism that is operatively coupled to the rotatable polishing pads to individually rotate each of the rotatable polishing pads. The rotational drive mechanism is configured to independently control the rotational speed of each of the rotatable polishing pads. The system may also include a vertical drive mechanism operatively coupled to the rotatable polishing pads to individually move each of the rotatable polishing pads along a vertical direction. The vertical drive mechanism is configured to independently control the pressure being applied to the object by each of the rotatable polishing pads.

In one embodiment, a method in accordance with the present invention includes the steps of providing an object to be polished, positioning a number of rotatable polishing pads over a surface of the object, and simultaneously polishing the object with the rotatable polishing pads. The step of positioning a number of rotatable polishing pads includes independently moving each of the rotatable polishing pads across the surface of the object. The rotatable polishing pads include at least one pad that has a surface area smaller than the surface are of the object.

In another embodiment, the step of positioning a number of rotatable polishing pads includes moving the rotatable polishing pads by pivoting at least one mechanical arm having at least one of the rotatable polishing pads, instead of including independently moving each of the rotatable polishing pads across the surface of the object.

In either embodiment, the step of simultaneously polishing the object includes individually controlling the lateral speed of each of the rotatable polishing pads across the surface of the object to control the amount of polishing by each of the rotatable polishing pads at different regions of the surface of the object. The step of simultaneously polishing the object may also include individually controlling the rotational speed of each of the rotatable polishing pads. The step of simultaneously polishing the object may also include individually controlling the downward pressure of each of the rotatable polishing pads on the object.

In either embodiment, the method may further include the step of conditioning a particular rotatable polishing pad on a pad conditioner, which is situated adjacent to the object such that the particular rotatable polishing pad can contact both the object and the pad conditioner. The method may also include the step of supporting a particular rotatable polishing pad on a supporting structure, which is situated adjacent to the object such that the particular rotatable polishing pad can contact both the object and the supporting structure.

Other aspects and advantages of the present invention will become apparent from the following detailed description, taken in conjunction with the accompanying drawings, illustrated by way of example of the principles of the invention.

DETAILED DESCRIPTION OF THE INVENTION

Figure 1:
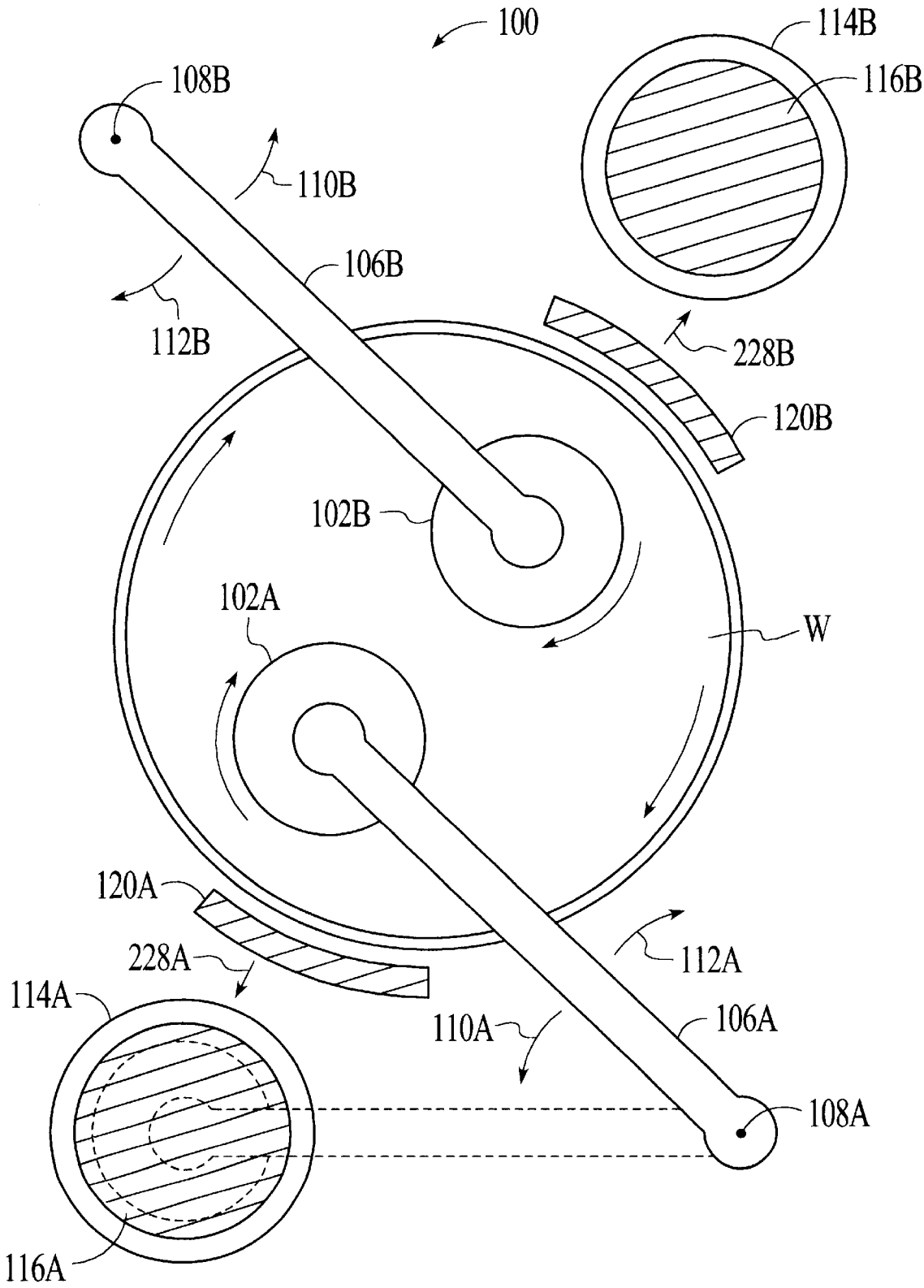
FIG. 1 is a top view of a mini CMP unit in accordance with a first embodiment of the present invention.
Figure 2:
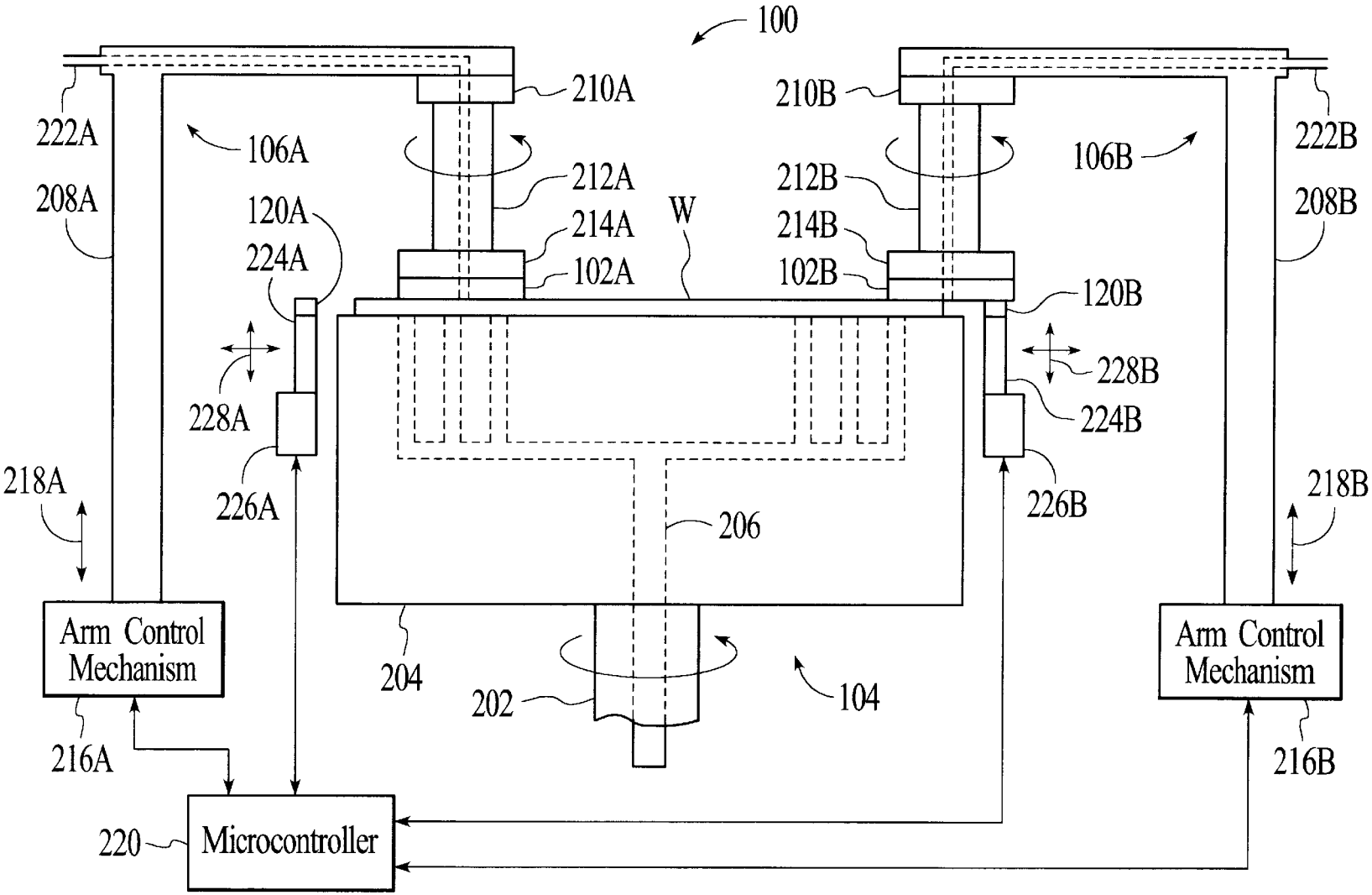
FIG. 2 is a cross-sectional view of the mini CMP unit of FIG. 1.
Figure 10:
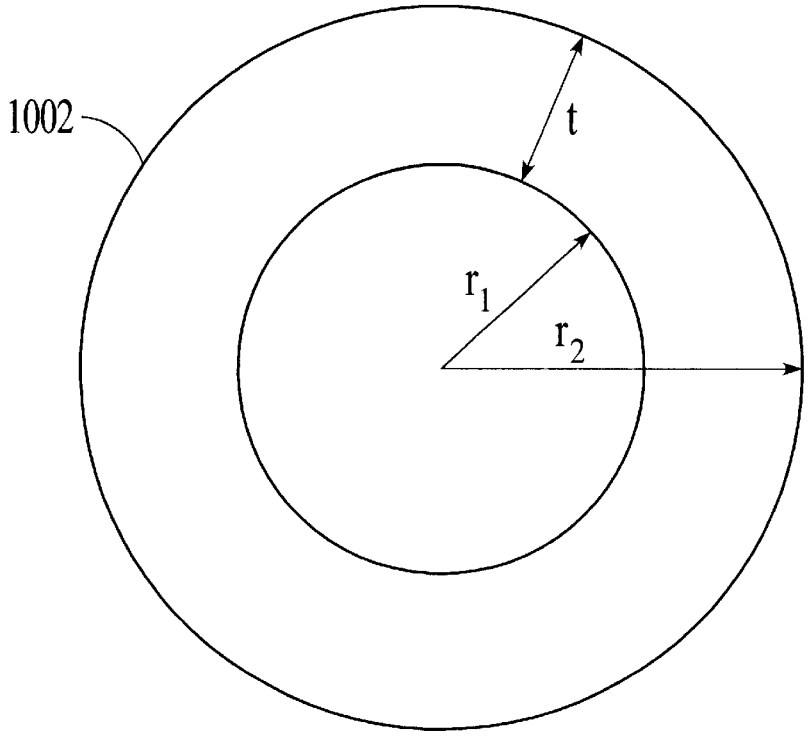
FIG. 10 is a bottom view of an exemplary ring-shaped polishing pad, which may be used by the present invention.

With reference to FIGS. 1 and 2, a mini chemical mechanical polishing (CMP) unit 100 in accordance with a first embodiment of the present invention is shown. FIG. 1 is a top view of the mini CMP unit, while FIG. 2 is a cross-sectional view of the mini CMP unit. The mini CMP unit utilizes multiple polishing pads having diameters that are smaller than the diameter of a semiconductor wafer being processed. Thus, the polishing pads have surface areas that are smaller than the surface area of the semiconductor wafer. Since the polishing pads are smaller than the wafer, the area occupied by the unit is generally smaller than conventional CMP units that utilize one or more polishing pads that are larger than the wafer. Thus, the footprint of a complete CMP system can be significantly reduced by using the mini CMP unit as a polishing unit or as a buffing unit. As illustrated in FIGS. 1 and 2, the mini CMP unit includes polishing pads 102A and 102B to simultaneously polish a semiconductor wafer W to decrease the length of the polishing period. Although the mini CMP unit 100 is shown to include only two polishing pads, the mini CMP unit may include additional polishing pads. The polishing pads may be of the type that contains abrasive particles on the pad surface. Furthermore, the polishing pads may be ring-shaped, as illustrated by an exemplary ring-shaped polishing pad 1002 in FIG. 10. The ring-shaped polishing pad of FIG. 10 is defined by radii $r_1$, and $r_2$, which may be varied to increase the lateral thickness t and the outer circumference of the polishing pad.

As best shown in FIG. 2, the mini CMP unit includes a wafer support base 104 and mechanical arms 106A and 106B. The wafer support base includes a shaft 202 and a wafer platform 204. The shaft of the wafer support base is connected to a motor (not shown) to rotate the wafer platform, and consequently the wafer W, which is placed on the wafer platform for polishing. The shaft and the wafer platform include a passageway 206 that extends to the surface of the wafer platform. The passageway may be used to supply air or deionized (DI) water to the underlying surface of the wafer placed on the wafer platform. Alternatively, the passageway may be used to create a vacuum to hold the wafer in place. The wafer support base may also include a wafer retainer ring (not shown), which functions as a lateral support for the wafer to ensure that the wafer remains on the wafer platform during polishing.

Each of the mechanical arms 106A and 106B of the mini CMP unit 100 is comprised of an arm frame 208, a rotation mechanism 210, an arm shaft 212 and a pad base 214. The polishing pad 102 is attached to the pad base, which is coupled to the arm shaft at one end. The other end of the arm shaft is attached to the rotation mechanism. The rotation mechanism rotates the arm shaft, which in turn rotates the pad base and the polishing pad. The rotation mechanism is attached to the arm frame that can pivot about the axis 108, as indicated in FIG. 1. The arm frame is coupled to an arm control mechanism 216 that operates on the arm frame to control the movement of the mechanical arm. The arm control mechanism is configured to pivot the arm frame so that the polishing pad can be swept across the wafer, as indicated by the arrows 110 and 112 in FIG. 1. The arm control mechanism is also configured to move the arm frame downward and upward, as indicated by the arrow 218, to adjust the pressure applied to the wafer by the polishing pad. Furthermore, the vertical movement of the arm frame allows the polishing pad to be removed from the wafer to selectively stop the polishing of the wafer by that polishing pad at a desired moment, which can be independent of the other polishing pad. The arm control mechanism is controlled by a microcontroller 220 of the mini CMP unit 100.

The microcontroller 220 is electrically connected to both arm control mechanisms 216A and 216B, which are coupled to the mechanical arms 106A and 106B. Thus, the microcontroller is able to control the individual pivoting movement of the mechanical arms by directing the arm control mechanisms to scan the polishing pads 102A and 102B across the wafer for polishing. That is, the microcontroller is able to direct the arm control mechanisms to individually pivot mechanical arms such that each mechanical arm pivots independent of the other mechanical arm. The length of time that a polishing pad remains on a relative location of the wafer affects the amount of polishing by that polishing pad. The amount of polishing increases as the polishing pad remains on a specific location. Since the microcontroller can control the movements of the polishing pads, the microcontroller is able to control the amount of polishing by the polishing pads at various locations. Through the arm control mechanisms, the microcontroller is also able to control the individual vertical movement of the mechanical arms to adjust the pressure applied to the wafer by the polishing pads, or to selectively disengage one of the polishing pads from the surface of the wafer to stop the polishing of the wafer by that polishing pad. The pressure applied to a wafer by a polishing pad also affect the amount of polishing by that polishing pad. The amount of polishing increases as the pressure applied to the wafer is increased. Thus, the microcontroller is able to control the amount of polishing by each of the polishing pads by adjusting the individual pressure being applied to the wafer by the polishing pads.

The microcontroller 220 is also connected to the rotation mechanisms 210A and 210B of the mechanical arms 106A and 106B. Thus, the microcontroller is able to control the individual rotational speed of the polishing pads 102A and 102B via the rotation mechanisms. The rotational speed of a polishing pad also affects the amount of polishing by that polishing pad. Thus, the microcontroller is able to control the amount of polishing being performed by each of the polishing pads by adjusting the individual rotational speed of the polishing pads. The microcontroller is also connected to the motor that rotates the wafer support base. Thus, the microcontroller is able to control the rotational speed of the wafer via the wafer support base.

Similar to the wafer support base 104, each of the mechanical arms 106A and 106B has an optional passageway 222 for slurry or DI water, depending on the application of the mini CMP unit 100. The passageway runs through the lateral portion of the arm frame 208 and down the arm shaft 212. The passageway further runs through the pad base 214 and the polishing pad 102. Thus, the passageway allows slurry or DI water to reach the interface between the polishing pad and the wafer. In an embodiment without the optional passageways, slurry or DI water may be supplied to the interface between the polishing pad and the wafer through alternative means, such as an external slurry pipe.

As shown in FIG. 1, the mini CMP unit 100 also includes a pair of parking stations, one for each of the polishing pads 102A and 102B. Each parking station provide a place for the associated polishing pad to be positioned during periods in between wafer polishing sessions when the polished wafer is removed from the mini CMP unit 100 and the next wafer to be polished is placed on the wafer support base 104, as illustrated by the phantom polishing pad positioned over the parking station 114A. The parking stations may be configured to supply DI water to the polishing pads when the polishing pads are positioned on the parking stations to prevent the polishing pads from drying. Each of the parking stations includes a pad conditioner 116, which is positioned on the upper surface of the parking station to interface with the polishing pad. The pad conditioner allows the polishing pad to be conditioned during the periods in between wafer polishing sessions. The surface of the pad conditioner may include known pad conditioning material, such as embedded diamond particulates or plastic bristles, to deglaze the polishing pad surface.

The mini CMP unit 100 may also include support structures 224A and 224B, as shown in FIG. 2. The support structures provide support for the polishing pads 102 when only a portion of the polishing pads is on the wafer W during polishing, as illustrated by the polishing pad 102B in FIG. 2. The support structures allow the polishing pads to remain leveled even when the polishing pads are on the edges of the wafer. As a result, the wafer surface can be more uniformly planarized, even along the edges of the wafers. The support structures are stationary and do not rotate with the wafer support base 104. The support structures are connected to positioning mechanisms 226A and 226B that adjust the positions of the support structures. The positioning mechanisms are able to vertically move the support structures to adjust the relative heights of the support structures with respect to the wafer, as indicated by the arrows 228A and 228B. In addition, the positioning mechanisms are able to laterally move the support structures to change the distance of the support structures from the wafer. The positioning mechanisms are controlled by the microcontroller. In an exemplary embodiment, each support structure includes a supplemental pad conditioner 120, as shown in FIGS. 1 and 2. The supplemental pad conditioners allow the polishing pads to be conditioned during polishing, as illustrated by the polishing pad 102B in FIG. 2.

Figure 3:
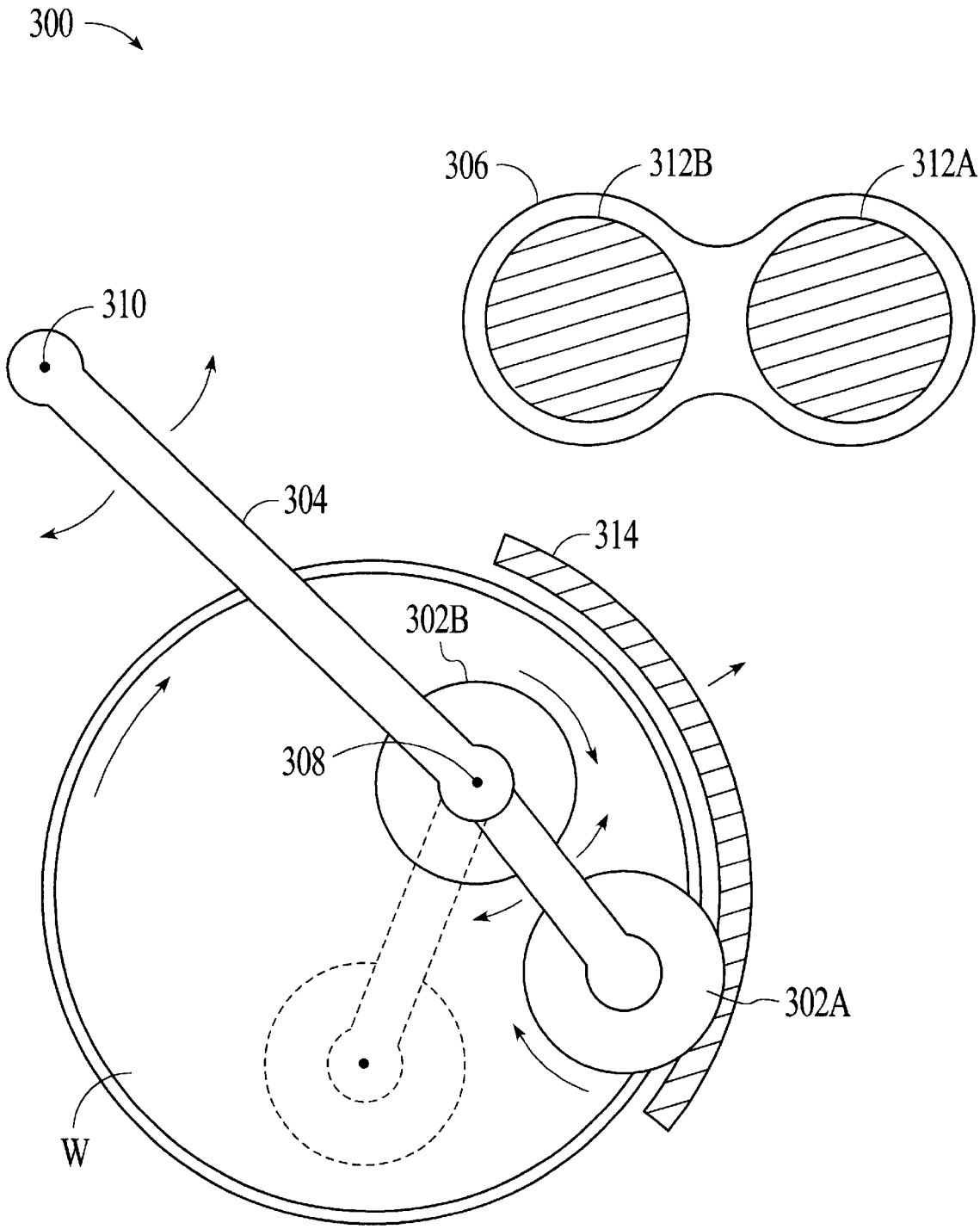
FIG. 3 is a top view of a mini CMP unit in accordance with a second embodiment of the invention.
Figure 4:
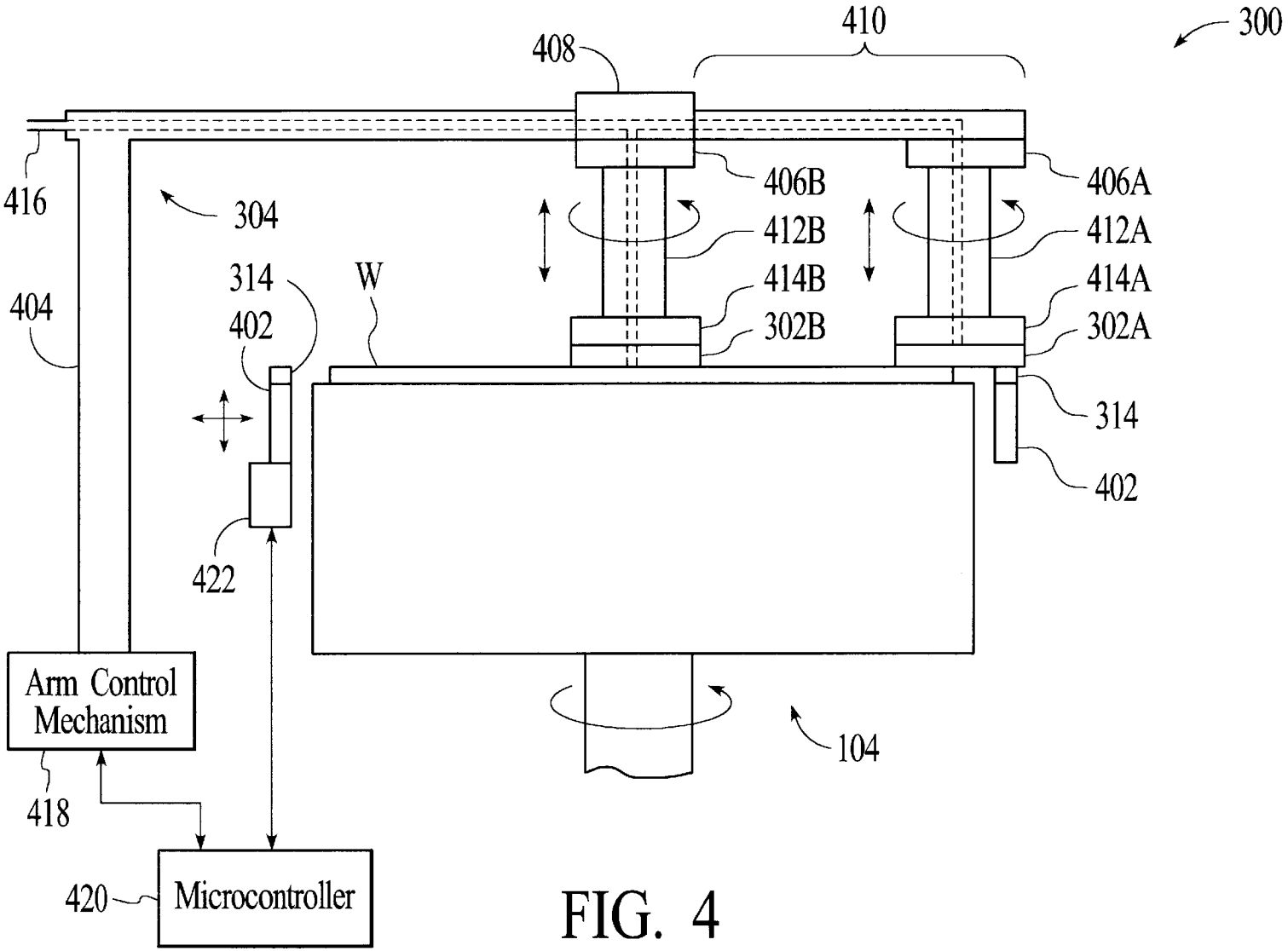
FIG. 4 is a cross-sectional view of the mini CMP unit of FIG. 3.

In FIGS. 3 and 4, a mini CMP unit 300 in accordance with a second embodiment of the invention is shown. Similar to the mini CMP unit 100 of the first embodiment, the mini CMP unit 300 utilizes multiple polishing pads 302A and 302B, which are smaller than the wafer W being polished, to simultaneously polish the wafer. In this embodiment, the multiple polishing pads are attached to a common mechanical arm 304 that pivots both polishing pads across the wafer.

As shown in FIGS. 3 and 4, the mini CMP unit 300 includes the wafer support base 104, the mechanical arm 304, a parking station 306, and a support structure 402. The mechanical arm is comprised of an arm frame 404, rotation-and-pressure mechanisms 406A and 406B, a pivot mechanism 408, an extension arm frame 410, arm shafts 412A and 412B, and pad bases 414A and 414B, which are shown in FIG. 4. The mechanical arm also includes an optional passageway 416 to supply slurry or DI water to the polishing pads. The rotation-and-pressure mechanism 406A operates to rotate the polishing pad 302A by rotating the arm shaft 412A. In addition, the rotation-and-pressure mechanism 406A operates to vertically move the polishing pad 302A by vertically moving the arm shaft 412A. Similarly, the rotation-and-pressure mechanism 406 B operates to rotate and to vertically move the polishing pad 302B. Thus, the polishing pads 302A and 302B can be rotated at different rotational speeds. Furthermore, the polishing pads can be independently lowered and raised to selectively contact the wafer for polishing and to selectively adjust the pressure being applied to the wafer by each polishing pad. The pivot mechanism 408 of the mechanical arm allows the extension arm frame 410 to be pivoted about the axis 308, as illustrated by the phantom extension arm frame and the phantom polishing pad in FIG. 3. Similar to the mechanical arms 106A and 106B of the mini CMP unit 100 of FIG. 1, the entire mechanical arm 304 can be pivoted about the axis 310 by an arm control mechanism 418. Thus, the polishing pad 302A can be pivoted about two different axes 308 and 310, which allows the polishing pad 302A to be moved with more control.

The arm control mechanism 418, the rotation-and-pressure mechanisms 406A and 406B, and the pivot mechanism 408 are controlled by a microcontroller 420. Thus, the microcontroller is able to control the individual pivoting movement of each of the polishing pads 302A and 302B by independently controlling the arm frame 404 and the extension arm frame 410. In addition, the microcontroller is able to control the individual rotation and the individual vertical movement of the polishing pads by independently controlling the rotation-and-pressure mechanisms.

In an alternative embodiment, the mechanical arm 304 may be configured such that the extension arm frame 410 can be manually pivoted about the axis 308 so that the angle between the arm frame 404 and the extension arm frame may be manually adjusted as needed. In another embodiment, the extension arm frame may be permanently fixed at an angle with respect to the arm frame.

The parking station 306 of the mini CMP unit 300 differs in shape with respect to the parking stations 114A and 114B of the mini CMP unit 100 of FIG. 1 to accommodate the two polishing pads 302A and 302B that are attached to the common mechanical arm 304. However, the parking station 306 serves the same function as the parking stations 114A and 114B. The parking station 306 includes two pad conditioners 312A and 312B for the two polishing pads. Alternatively, the two pad conditioners 312A and 312B can be replaced with a single large pad conditioner that can accommodate both the polishing pads 302A and 302B.

Similar to the support structures 224A and 224B of the mini CMP unit 100 of FIG. 1, the support structure 402 of the mini CMP unit 300 provides support for the polishing pads 302A and 302B during polishing. The support structure is connected to a positioning mechanism 422 that controls the vertical and lateral movements of the support structure. The support structure also includes a supplemental pad conditioner 314. In an alternative embodiment, the support structure 402 can be divided into two support structures, each with a supplemental pad conditioner for each of the polishing pads 302A and 302B.

Figure 5:
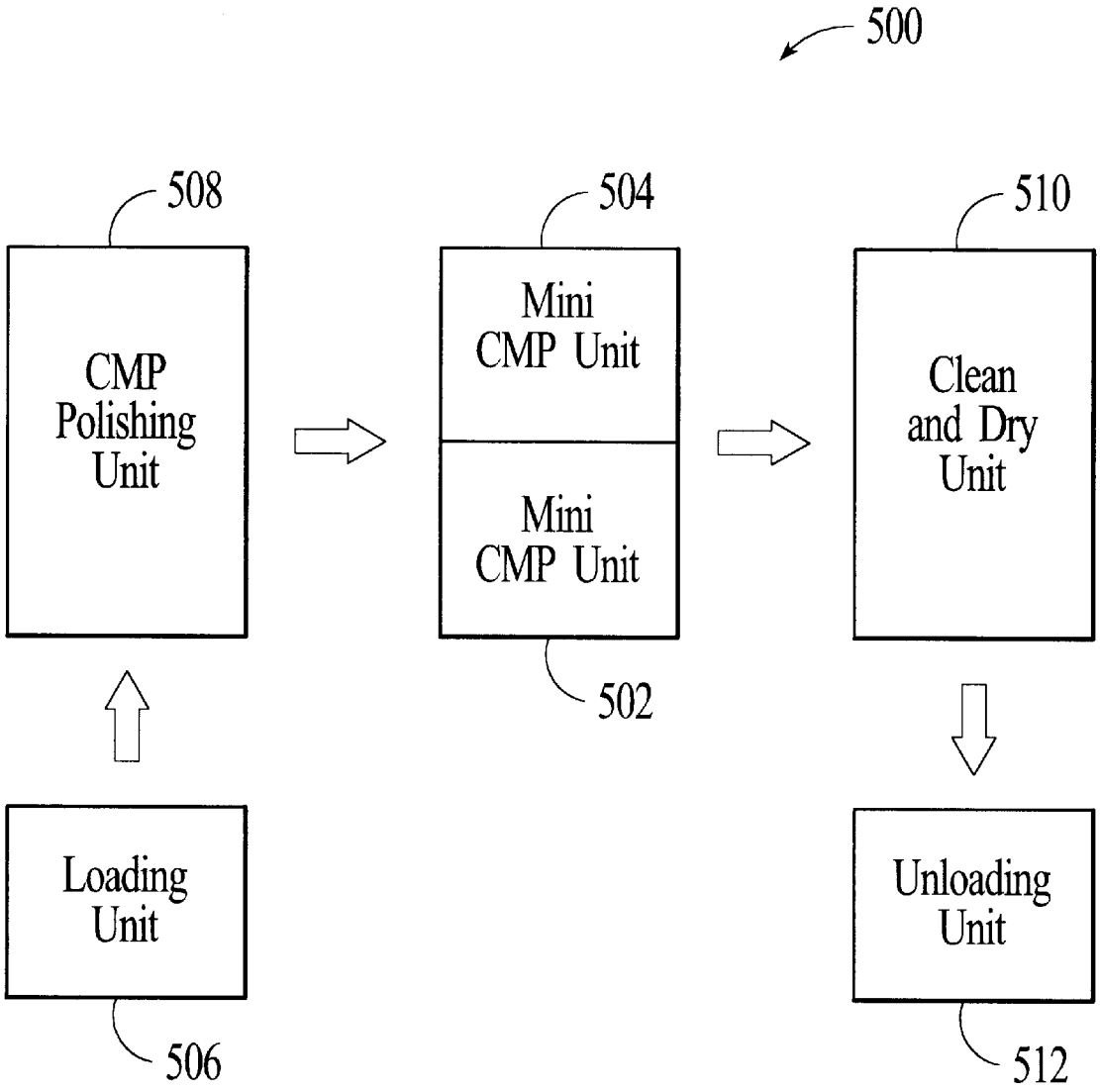
FIG. 5 is a block diagram of a CMP system in accordance with a first embodiment of the invention.

In FIG. 5, a CMP system 500 in accordance with a first embodiment is shown. The CMP system includes a number of mini CMP units 502 and 504 that function as buffing units. Although the CMP system is shown in FIG. 5 to include only two mini CMP units, the CMP system may include additional mini CMP units. The mini CMP units included in the CMP system may be the type exemplified by the mini CMP unit 100 of FIGS. 1 and 2, or the type exemplified by the mini CMP unit 300 of FIGS. 3 and 4. Alternatively, the CMP system may include a combination of the mini CMP unit 100 and the mini CMP unit 300.

As shown in FIG. 5, the CMP system includes a loading unit 506, a polishing unit 508, the mini CMP units 502 and 504, a clean-and-dry unit 510, an unloading unit 512 and a number of wafer handling mechanisms (not shown). The loading unit provides a supply of wafers to be chemically and mechanically polished. The loading unit may be designed to hold one or more supply wafer cartridges. Similarly, the unloading unit may be designed to hold a number of wafer cartridges. The wafer cartridges are used by the unloading unit to store the wafers that have been processed by the CMP system. The polishing unit is the main polisher that chemically and mechanically polishes wafers. The polishing unit may be any type of CMP polishing units, such as the CMP polishing units that are currently available for commercial use. The polishing unit may be designed to polish only one wafer at a time. Preferably, the polishing unit is designed to simultaneously polish multiple wafers. The polishing unit receives one or more wafers from the loading unit and then polishes the wafers. The polished wafers are then transferred to the mini CMP units.

The mini CMP units 502 and 504 of the CMP system 500 operate as buffing units to buff and/or to further polish the wafers from the polishing unit 508. Depending on the wafers being processed, the mini CMP units may utilize a slurry of fine abrasive particles or DI water. In one embodiment, the mini CMP units sequentially process a given wafer. Thus, the wafer may first be processed by the mini CMP unit 502 and then, further processed by the mini CMP unit 504. In this embodiment, each of the mini CMP units may utilize a different polishing solution, depending on the desired finish of the semiconductor wafers. In another embodiment, the mini CMP units process a pair of wafers in parallel to increase the throughput of the system. In this embodiment, both of the mini CMP units utilize the same polishing solution or DI water.

The clean-and-dry unit 510 of the CMP system 500 operates to clean the wafers that are processed by the mini CMP units 502 and 504. In an exemplary embodiment, the clean-and-dry unit includes two spin scrubbing modules that sequentially clean a given wafer. Each of the spin scrubbing modules operates to clean the wafer with DI water by using a pair of sponge brush scrubbers, one for each surface of the wafer. The clean-and-dry unit may also include a spinning module that dries the cleaned wafers by a spin drying process. The clean-and-dry unit may be any known type of CMP cleaning units that are currently available for commercial use.

Figure 6:
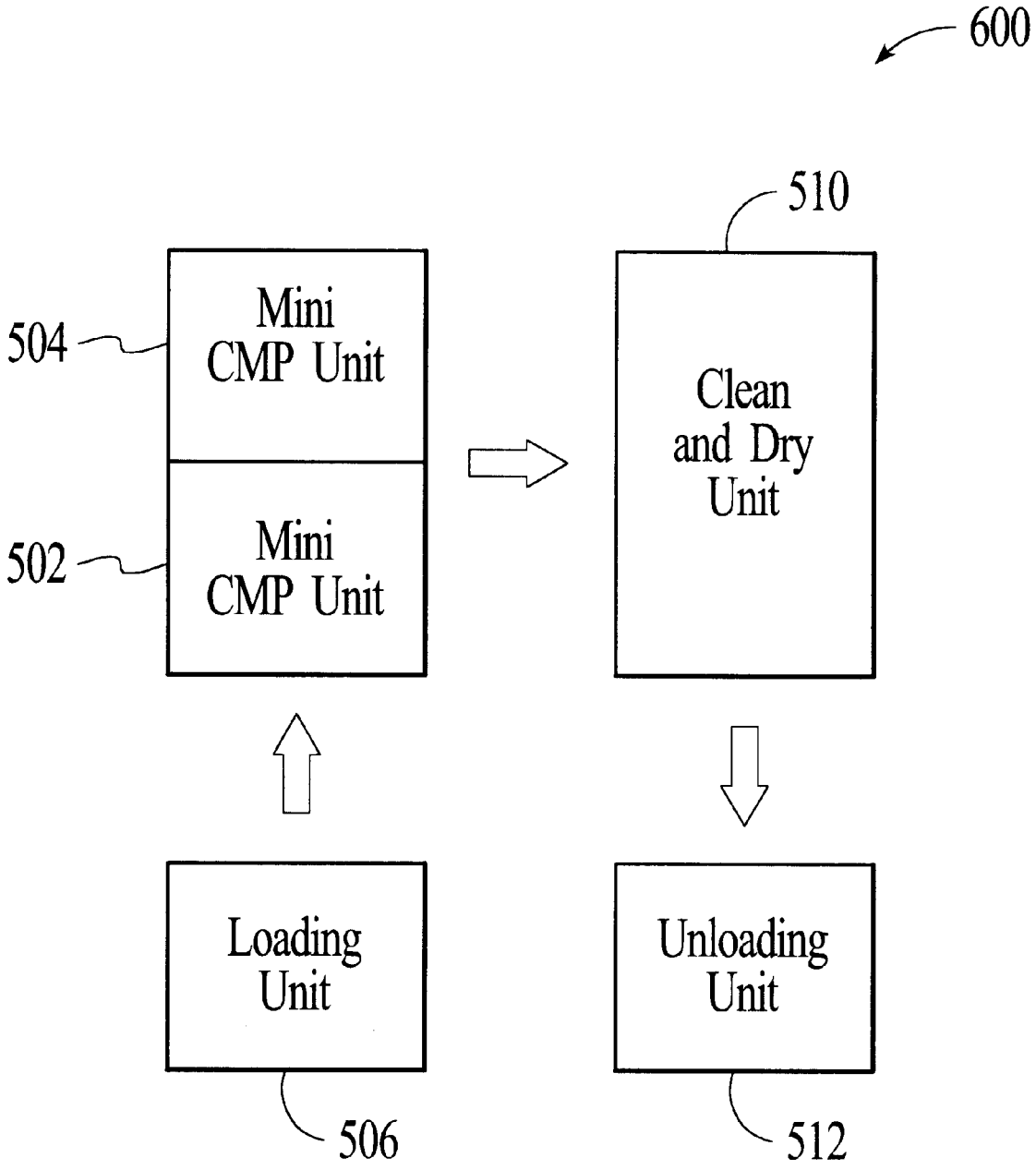
FIG. 6 is a block diagram of a CMP system in accordance with a second embodiment of the invention.

In FIG. 6, a CMP system 600 in accordance with a second embodiment is shown. In this embodiment, the CMP system utilizes the mini CMP units 502 and 504 as main polishing units, instead as buffing units. Similar to the CMP system 500 of FIG. 5, the CMP system 600 may include additional mini CMP units. As shown in FIG. 6, the CMP system 600 includes the loading unit 506, the mini CMP units 502 and 504, the clean-and-dry unit 510, the unloading unit 512 and a number of wafer handling mechanisms (not shown). As stated above, the mini CMP units of the CMP system 600 operate as main polishing units. Thus, in this embodiment, the CMP technique performed by the CMP system does not include buffing. The mini CMP units receive one or more wafers from the loading unit and then polishes the wafers. In one embodiment, the mini CMP units sequentially polish a given wafer. That is, the wafer is partially polished by the mini CMP unit 502 and then, further polished by the mini CMP unit 504. In this embodiment, each of the mini CMP units may utilize a different polishing solution, depending on the desired finishing result of the CMP system. In another embodiment, the mini CMP units process a pair of wafers in parallel to increase the throughput. In this embodiment, both of the mini CMP units utilize the same polishing solution. After the wafers are polished by the mini CMP units, the wafers are cleaned and dried by the clean-and-dry unit for cleaning and drying. The cleaned and dried wafers are then transferred to the unloading unit, which completes the CMP process.

Figure 7:
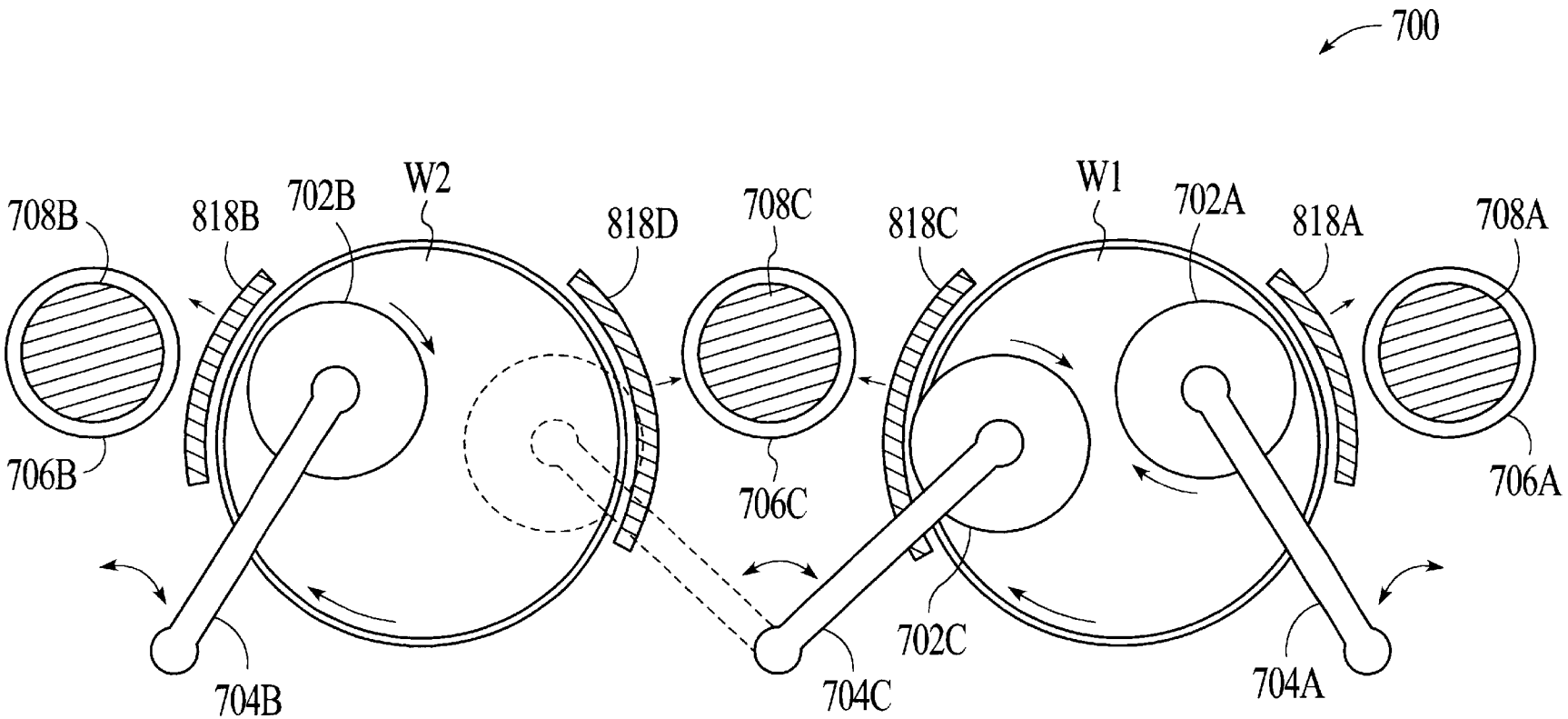
FIG. 7 is a top view of a mini 2-wafer CMP unit in accordance with a third embodiment of the invention.
Figure 8:
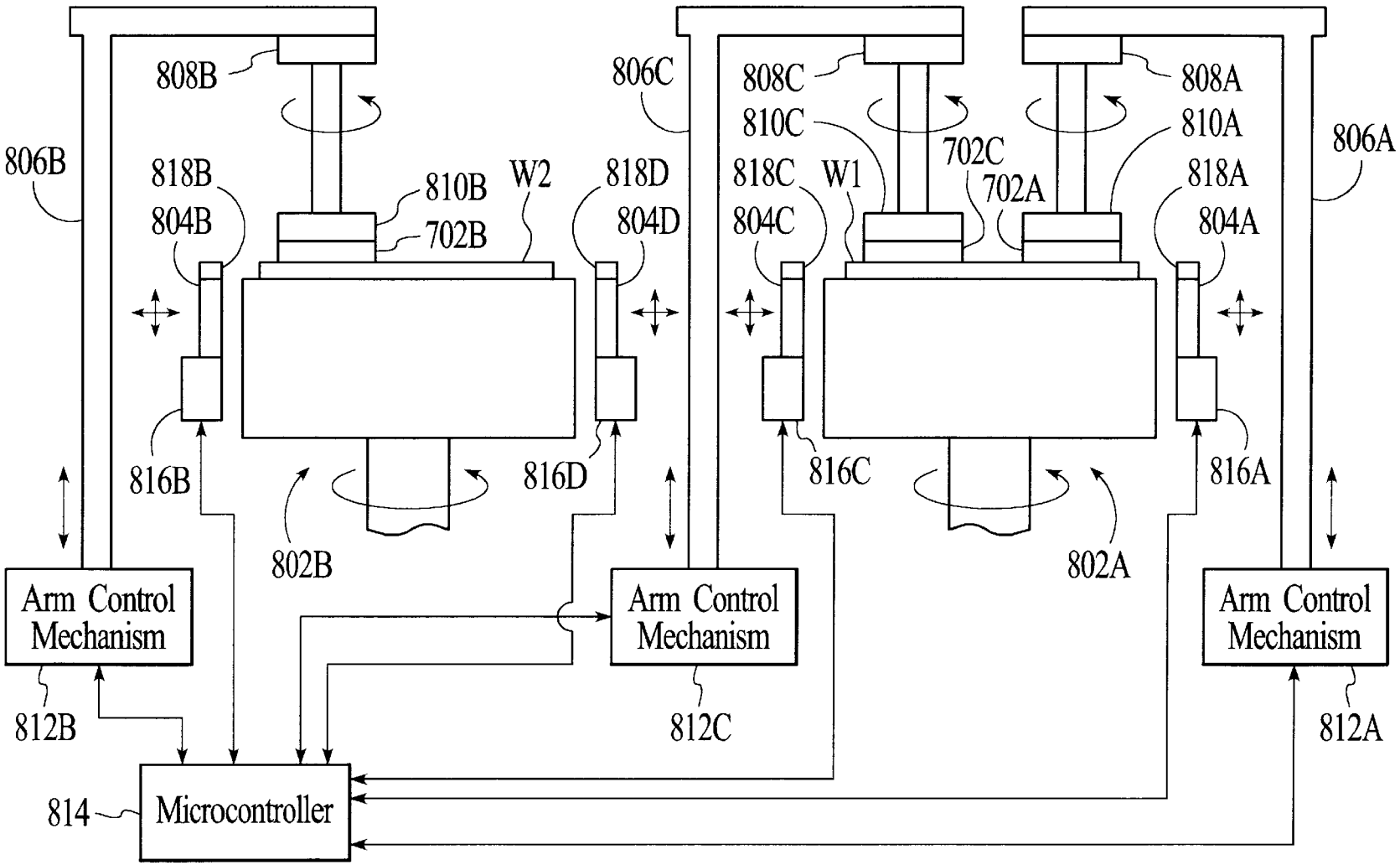
FIG. 8 is a cross-sectional view of the mini 2-wafer CMP unit of FIG. 7.

In FIGS. 7 and 8, a mini 2-wafer CMP unit 700 in accordance with a third embodiment of the invention is shown. Similar to the mini CMP units 100 and 300 of the first and second embodiments, the mini 2-wafer CMP unit utilizes multiple polishing pads 702A, 702B and 702C, which are smaller than the wafers W1 and W2 being polished. However, in this embodiment, the polishing pad 702C is used to polish both of the wafers.

As shown in FIGS. 7 and 8, the mini 2-wafer CMP unit 700 includes wafer support bases 802A and 802B, mechanical arms 704A, 704B and 704C, parking stations 706A, 706B and 706C, and support structures 804A, 804B, 804C and 804D. The wafer support bases 802A and 802B are identical to the wafer support base 104 in FIG. 2. Similar to the mini CMP unit 100 of FIGS. 1 and 2, each of the mechanical arm 704A, 704B and 704C of the mini 2-wafer CMP unit 700 comprises of an arm frame 806, a rotation mechanism 808, and a pad base 810, which is attached one of the polishing pads 702A, 702B and 702C. Although not shown, each mechanical arm may also include an optional passageway for polishing solution or DI water to reach the polishing pad. As shown in FIG. 8, the mini 2-wafer CMP unit further includes arm control mechanisms 812A, 812B and 812C and a microcontroller 814. Since there are three mechanical arms, the mini 2-wafer CMP unit 700 also includes three arm control mechanisms, which are controlled by the microcontroller. The microcontroller also controls positioning mechanisms 816A, 816B, 816C and 816D, which are connected to the support structures 804A, 804B, 804C and 804D.

Similar to the support structures 224A and 224B of FIG. 2, the support structures 804A, 804B, 804C and 804D include supplemental pad conditioners 818A, 818B, 818C and 818D, respectively. Similarly, the parking stations 706A, 706B and 706C include pad conditioners 708A, 7088 and 708C, respectively. The support structure 804A and the parking station 706A are for the rotatable polishing pad 702A, while the support structure 804B and the parking station 706B are for the rotatable polishing pad 702B. The support structures 804C and 804D and the parking station 706C are for the rotatable polishing pad 702C.

In operation, the polishing pad 702A of the mini 2-wafer CMP unit 700 polishes the wafer W1 on the wafer support base 802A, while the polishing pad 702B polishes the wafer W2 on the wafer support base 802B. In addition to the polishing by the polishing pads 702A and 702B, the wafers are also polished by the third polishing pad 702C. Thus, the third polishing pad 702C functions as a supplemental polishing pad to additionally polish the wafers, which are being polished in parallel by the mini 2-wafer CMP unit.

Similar to the mini CMP units 100 and 300, the mini 2-wafer CMP unit 700 of FIGS. 7 and 8 may be used as a CMP polishing unit or a buffing unit in a CMP system. In one embodiment, the mini CMP units 502 and 504 of the CMP system 500 of FIG. 5 are replaced with the mini 2-wafer CMP unit 700 to function as a buffing unit. As part of the CMP system 500, the mini 2-wafer CMP unit can buff/polish the wafers that have been polished by the CMP polishing unit 508. In another embodiment, the mini CMP units 502 and 504 of the CMP system 600 of FIG. 6 may be replaced by the mini 2-wafer CMP unit 700 to function as a CMP polishing unit.

Figure 9:
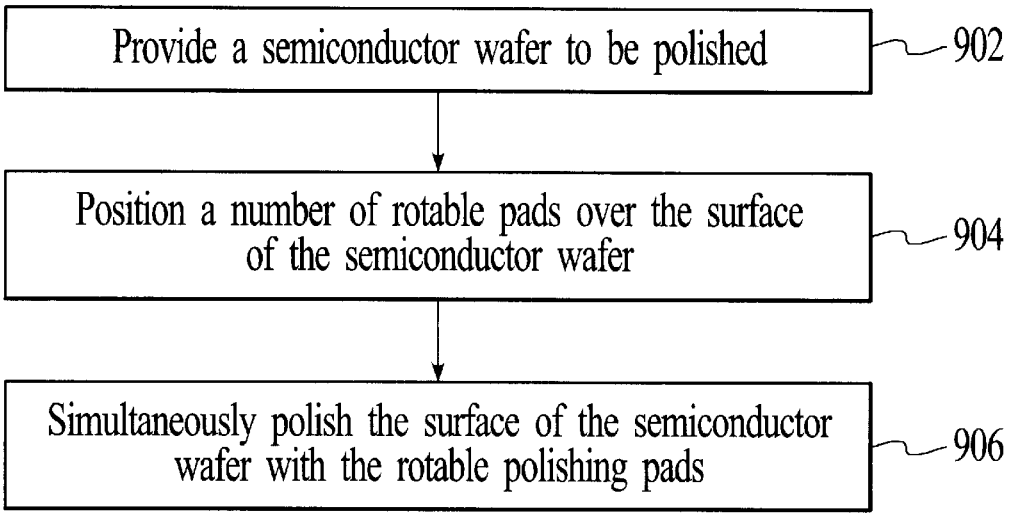
FIG. 9 is a process flow diagram of a method of polishing semiconductor wafers in accordance with the present invention.

A method of polishing semiconductor wafers is described with reference to FIG. 9. At step 902, a semiconductor wafer to be polished is provided. Next, at step 904, a number of rotatable polishing pads are positioned over the surface of the semiconductor wafer. The rotatable polishing pads have surface areas that are smaller than the surface area of the semiconductor wafer. As an example, the rotatable polishing pads may be positioned over the wafer surface by pivoting one or more mechanical arms that includes one or more rotatable polishing pads. At step 906, the surface of the semiconductor wafer is simultaneously polished with the rotatable polishing pads. During step 906, the rotatable polishing pads may be scanned across the wafer surface at variable speeds to control the amount of polishing by the rotatable polishing pads at different regions of the wafer surface. In addition, the rotational speed and the downward pressure of each rotatable polishing pad may be controlled to control the amount of polishing by the rotatable polishing pads.

What is claimed is:

1. A system for polishing surfaces of objects comprising;

a rotatable platform that provides support for an object to be polished;

a secondary rotatable platform that provides support for a second object to be polished;

a plurality of rotatable polishing pads, at least one of said rotatable polishing pads having a surface area smaller than the surface area of said object to be polished; and means for independently moving each of said rotatable polishing pads laterally across a surface of said object, said moving means being configured such that at least two rotatable polishing pads can be positioned over said surface of said object to simultaneously polish said object, said moving means including a multi-object mechanical arm having a multi-object rotatable polishing pad, said multi-object rotatable polishing pad having a surface area smaller that the surface areas of said object and said second object, said multi-object mechanical arm being configured to pivot about an arm axis such that said multi-object rotatable polishing pad can scan said object and said second object to polish both said object and said second object when said multi-object mechanical arm is pivoted.

2. The system of claim 1 wherein said moving means further includes a first primary mechanical arm having a first rotatable polishing pad and a second primary mechanical arm having a second rotatable polishing pad, said first primary mechanical arms being configured to pivot such that said object is scanned by said first rotatable polishing pad when said first primary mechanical arms is pivoted, said second primary mechanical arms being configured to pivot such that said second object is scanned by said second rotatable polishing pad when said second primary mechanical arms is pivoted.

3. A system for polishing surfaces of objects comprising;

a rotatable platform that provides support for an object to be polished;

a plurality of rotatable polishing pads, at least one of said rotatable polishing pads having a surface area smaller than the surface area of said object to be polished; and means for independently scanning each of said rotatable polishing pads laterally across a surface of said object about a fixed axis, said scanning means being configured such that at least two rotatable polishing pads can be positioned over said surface of said object to simultaneously polish said object, said scanning means including a mechanical arm having said rotatable polishing pads, said mechanical arm being configured to pivot about said fixed axis such that said rotatable polishing pads can be positioned over said surface of said object to simultaneously polish said object, said mechanical arm including a first section and a second section, each of said first and second sections of said mechanical arm having one of said rotatable polishing pads, said second section of said mechanical arm being configured to pivot about an end of said first section of said mechanical arm.

4. A system for polishing surfaces of objects comprising:

a rotatable platform that provides support for an object to be polished;

a plurality of rotatable polishing pads, at least one of said rotatable polishing pads having a surface area smaller than the surface area of said object to be polished; and means for scanning each of said rotatable polishing pads laterally across a surface of said object about a fixed axis, said scanning means including a mechanical arm having said rotatable polishing pads, said mechanical arm being configured to pivot about said fixed axis such that at least two of said rotatable polishing pads can be positioned over said surface of said object to simultaneously polish said object, said mechanical arm including a first section and a second section, each of said first and second sections of said mechanical arm having one of said rotatable polishing pads, said second section of said mechanical arm being configured to pivot about an end of said first section of said mechanical arm.

5. A system for polishing surfaces of objects comprising:

a rotatable platform that provides support for an object to be polished;

a secondary rotatable platform that provides support for a second object to be polished;

a plurality of rotatable polishing pads, at least one of said rotatable polishing pads having a surface area smaller than the surface area of said object to be polished; and means for independently scanning each of said rotatable polishing pads laterally across a surface of said object about a fixed axis, said scanning means being configured such that at least two rotatable polishing pads can be positioned over said surface of said object to simultaneously polish said object, said scanning means includes a multi-object mechanical arm having a multi-object rotatable polishing pad, said multi-object rotatable polishing pad having a surface area smaller that the surface areas of said object and said second object, said multi-object mechanical arm being configured to pivot about an arm axis such that said multi-object rotatable polishing pad can scan said object and said second object to polish both said object and said second object when said multi-object mechanical arm is pivoted.

6.The system of claim 5 wherein said scanning means further includes a first primary mechanical arm having a first rotatable polishing pad and a second primary mechanical arm having a second rotatable polishing pad, said first primary mechanical arms being configured to pivot such that said object is scanned by said first rotatable polishing pad when said first primary mechanical arms is pivoted, said second primary mechanical arms being configured to pivot such that said second object is scanned by said second rotatable polishing pad when said second primary mechanical arms is pivoted.

* * * * *